US008485170B1

(12) United States Patent
Prior

(10) Patent No.: US 8,485,170 B1
(45) Date of Patent: Jul. 16, 2013

(54) PROJECTILE LAUNCHER WITH INTERNAL BOW

(71) Applicant: Michael W. Prior, Silver Spring, MD (US)

(72) Inventor: Michael W. Prior, Silver Spring, MD (US)

( * ) Notice: Subject to any disclaimer, the term of this patent is extended or adjusted under 35 U.S.C. 154(b) by 0 days.

(21) Appl. No.: 13/764,700

(22) Filed: Feb. 11, 2013

(51) Int. Cl.
*F41B 7/04* (2006.01)

(52) U.S. Cl.
USPC ..... 124/27; 124/25; 124/26

(58) Field of Classification Search
USPC ..... 124/16, 23.1, 24.1, 25, 26, 27
See application file for complete search history.

(56) References Cited

U.S. PATENT DOCUMENTS 3,509,863 A 5/1970 Barker
3,968,783 A 7/1976 Pfotenhauer
4,169,456 A 10/1979 Van House
5,355,866 A * 10/1994 Hunter ..... 124/26
6,273,078 B1 8/2001 Schwesinger
7,743,760 B2 6/2010 Woodland
7,836,871 B2 11/2010 Kempf
7,926,474 B2 4/2011 Berry
7,997,258 B2 8/2011 Shepley et al.

* cited by examiner

*Primary Examiner* — John Ricci
(74) *Attorney, Agent, or Firm* — Richard C. Litman

(57) ABSTRACT

The projectile launcher with internal bow includes a riser base, an elongate barrel assembly attached to the riser base, a crank mechanism attached to the back of the barrel assembly, a trigger assembly, and an internal bow assembly mounted to the riser base. The crank assembly includes a rotatable crank for selective reciprocation of a cocking pawl carriage riding inside a rail system in the barrel assembly. A biased cocking pawl in the pawl carriage selectively engages a projectile stirrup carriage riding on top of the rail system to push the stirrup carriage into a cocked position. The internal bow assembly includes reversed and vertically spaced, upper and lower resilient bow arms and respective pulleys and cables interconnecting the bow arms and the stirrup carriage. Cocking of the stirrup carriage flexes the bow arms in preparation for placement and firing of a projectile.

16 Claims, 13 Drawing Sheets

PROJECTILE LAUNCHER WITH INTERNAL BOW

BACKGROUND OF THE INVENTION

1. Field of the Invention

The present invention relates to archery weapons, and particularly to a projectile launcher provided with covered, internalized bow elements and corresponding cocking mechanism for increased balance, safe handling, and minimized effort in operation.

2. Description of the Related Art

Crossbows have long been known in the art. The traditional design dates back to the 14th century or earlier, when very high powered crossbows were effective, especially against armored horsemen. A large medieval crossbow of circa 1500 AD might have a draw weight of 1200 lbs. and a range of 450 yards. In modern times, crossbows rarely exceed 200 lbs. draw weight. Modern crossbows now use sighting mechanisms of various sorts, advanced composite materials and metal alloys, wheel/pulley systems, etc., but otherwise are little changed, except in style and construction materials. Draw weights are dramatically lower, which are tailored to target shooting or hunting applications, rather than warfare.

Crossbows normally use rifle style stocks. Indeed, the modern rifle design originated with the medieval crossbow. Sights may be aperture sights as found on a rifle, pin sights as on a compound longbow, or telescopic sights. A modern 200 lb. draw weight heavyweight crossbow will achieve similar projectile speeds to a 60 lb. peak draw weight compound hand bow, and the bolt and arrow weights are also similar (300-400 grains).

The crossbow, being relatively short compared to recurve bows and the like, requires comparatively more force to bend. Most crossbows must be cocked by using the feet and legs or a mechanical aid for very powerful bows. Because of the large amount of force applied and mechanical energy stored and released, significant safety concerns exist due to the structure of a conventional crossbow.

The bowstring sweeps along the top of the bow, and it is external. The bow limbs extend out to the sides of the crossbow and sweep forward when fired. The bolt travels openly exposed down the rail at high speeds when fired. Consequently, the user must exercise caution when cocking and uncocking, handling a cocked bow (whether loaded or unloaded), and firing to avoid inadvertent bodily contact with high energy and sharpened bow components. For example, the user must always take into account the sweep of the limbs when firing to prevent limb contact with external objects, which can cause significant back force into the stock and ultimately to the user's body (often facial area). The user must avoid putting fingers/hands between the cocked bow and the bowstring.

The traditional crossbow, with its exposed mechanism and bowstring cocking mechanism, is not a compact design which presents some ease of use concerns when applied to hunting applications, compared to a firearm/gun and even the typical longbows and the like. The large cross-sectional area created by the bow limbs being mounted transverse to the stock can result in frequent snagging with tree limbs and foliage when being transported in the field. Mitigating the safety concerns described above often results in limited shooting angles when hunting in close proximity to trees due to the need for accommodating a "safe zone" around the bow limbs. The use of external (to the bow) cocking mechanisms that must be attached to the bow each time it is cocked or uncocked and that rely upon the physical strength of the user to perform these actions can often result in cumbersome and strenuous manipulations of the bow and associated equipment in a hunting scenario due to limited space.

The use of the cross-mounted bow and string also introduce potential shooting inaccuracy. Unless the bow is exactly evenly cocked such that the bowstring center point is being held by the trigger mechanism, side forces will be imparted on the bolt during acceleration down the rail, which will adversely affect its flight accuracy. Cocking the bow even 1/16" off center will drastically change the bolt's point of impact.

Accurate aiming with crossbows is also adversely affected by their typical design. The conventional crossbow has an imbalanced weight distribution, which places the center of mass far forward of the weapon due to the bow limbs and associated mounting placed at the distal end of the rail or table. Thus, the user must compensate and support the weighty forward end with more strength and care during aiming compared to typical firearms, such as rifles or the conventional recurve bow. One attempt to address this issue places the mounting hardware near the rear of the elongate table, and the bow limbs are mounted in reverse orientation from traditional, i.e., the arch of the bow faces the user instead of away from the user. This type of crossbow may provide better balance, but it still experiences the same type of concerns mentioned above, i.e., safety and the need to accommodate the cross-extending bow limbs during use.

Another concern of traditional crossbow designs arises from the results of a completed shot. The sudden dissipation of energy at the end of a shot through various components of the crossbow can cause excessive vibration in the bowstring resulting in noise akin to a plucked guitar string. Since hunting requires a degree of stealth, anything compromising this aspect, such as the noise from a loosed bowstring, is highly undesirable. One solution includes dampener accessories mounted to the bowstring or bow assembly. While they may assist in lessening the vibrations, they are another of many various accessories that the user must consider. Depending on the size and complexity of such dampeners, they can negatively impact mobility and space required for hunting as well as projectile performance.

In light of the above, it would be a benefit in the art of archery weapons to provide a crossbow-type weapon that provides better balance, enhanced safety in handling, ease of cocking and uncocking the weapon, quiet operation and stealth. Thus, a projectile launcher with internal bow solving the aforementioned problems is desired.

SUMMARY OF THE INVENTION

The projectile launcher includes a riser base, an elongate barrel assembly attached to the riser base, a crank mechanism attached to the back of the barrel assembly, a trigger assembly, and an internal bow assembly mounted to the riser base. The crank assembly includes a rotatable crank for selective reciprocation of a cocking pawl carriage riding inside a rail system in the barrel assembly. A biased cocking pawl in the pawl carriage selectively engages a projectile stirrup carriage riding on top of the rail system to push the stirrup carriage into a cocked position. The internal bow assembly includes vertically spaced upper and lower resilient bow arms and respective pulleys and cables interconnecting the bow arms and the stirrup carriage. Cocking of the stirrup carriage flexes the bow arms in preparation for placement and firing of a projectile. The working components of the projectile launcher are enclosed by a covering to protect the user. An integral quiver can also be provided.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
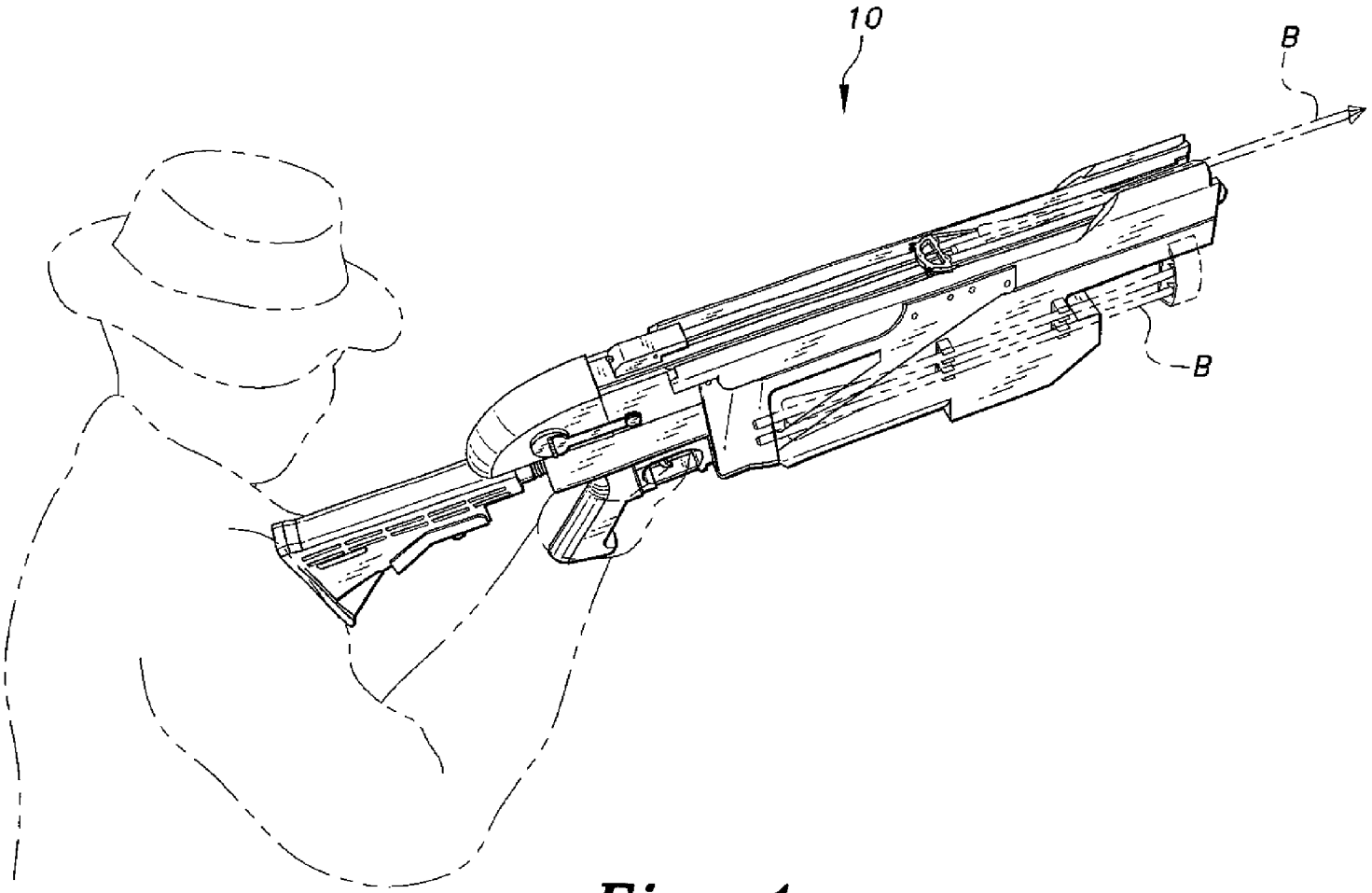
FIG. 1 is an environmental, perspective view of a projectile launcher according to the present invention.
Figure 2:
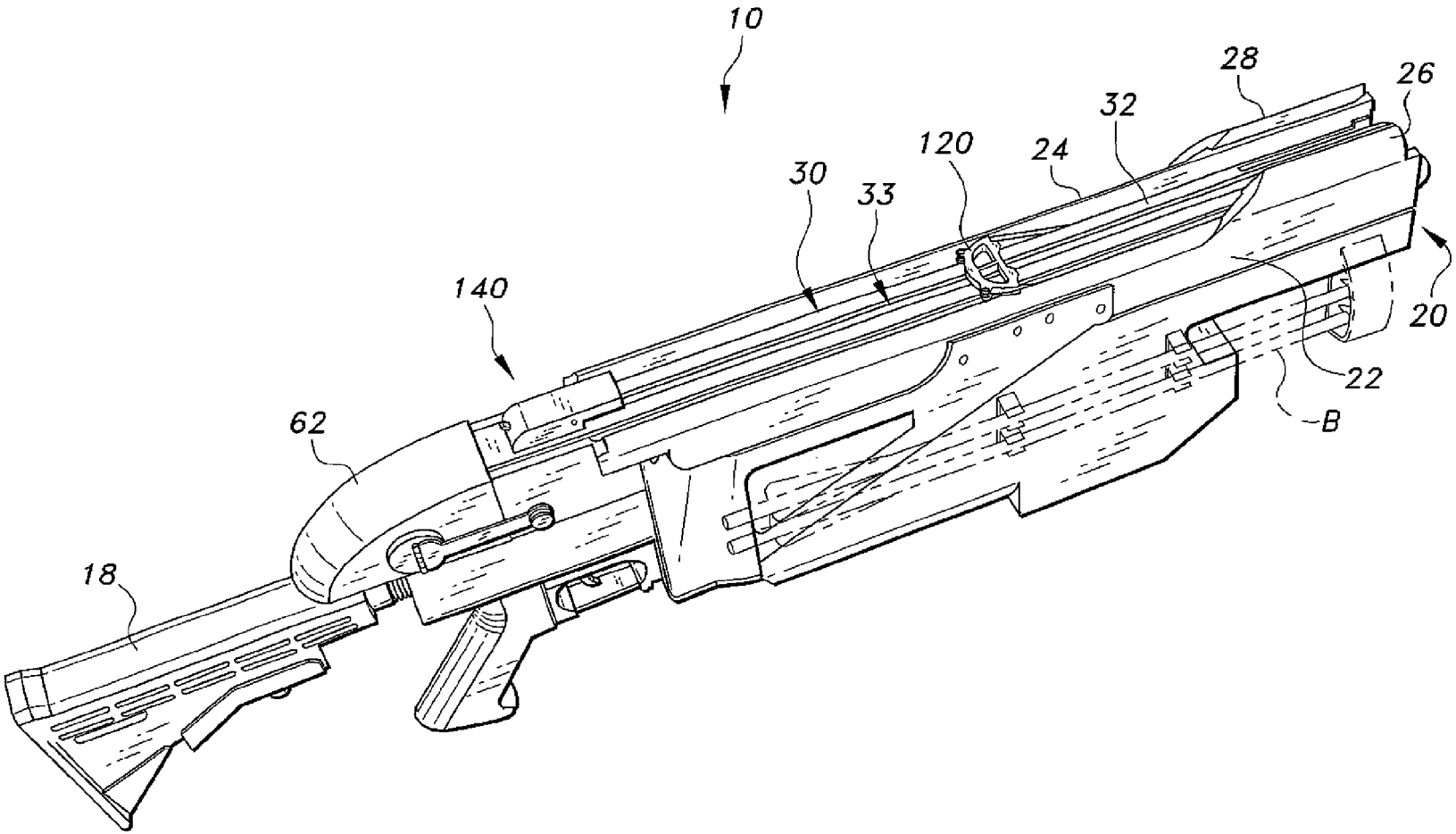
FIG. 2 is a perspective view of the projectile launcher of FIG. 1.

The projectile launcher, a first embodiment of which is generally referred to by the reference number 10, provides a well-balanced and enhanced, safe-handling/firing archery-type weapon in a relatively compact form. The term "projectile launcher" as used herein refers to a device capable of launching various types of elongate projectiles B, such as crossbow bolts, arrows, stakes, etc., that may be provided with either blunt or sharpened tips. As shown in FIGS. 1-4, the projectile launcher 10 includes a riser base 12 where the rest of the components of the projectile launcher 10 are mounted or attached. The riser base 12 is a substantially L-shaped block having a vertical short section 14 and an integral long section 16 extending transversely from an end of the short section 14. A portion of the long section 16 that meets with the short section 14 is notched, forming a mounting ledge 15 for mounting one of the bow limbs, the details of which will be further described below. The riser base 12 is preferably constructed from relatively lightweight, yet strong, durable material, such as aluminum, but other similar metals, wood, composites, and combinations thereof can also be used. The short section 14 is preferably solid, since this portion experiences the most stress, while the long section 16 includes an elongate slot 17 for passage of a trigger mechanism 140, to be described below. To reduce weight, portions of the short section 14 can be removed without adversely affecting the structural integrity, performance and function of this component. A stock 18 is detachably mounted to the distal end of the long section 16.

An elongate barrel assembly 20 is disposed along the top length of the long section 16. The barrel assembly 20 includes a pair of elongate side panels 22, 24 attached to sides of a rail system 30 disposed between the side panels 22, 24. The rail system 30 facilitates cocking and loosing of a projectile B, such as a crossbow bolt. The side panels 22, 24 are preferably elongate, rectangular plates having a height extending above the top surface of the rail system 30, thereby serving as side guards. Additionally, each side panel 22, 24 includes respective upwardly extending curved projections 26, 28 at the distal end. Each projection 26, 28 curves inwardly towards the central rail system 30, partially covering that end of the barrel assembly 20. These curved projections 26, 28 also serve as protective guards, providing limited cover over the sharp tip of the projectile B when cocked. Moreover, they can also serve as a crude, integral sight, similar to the aperture sights on typical firearms.

As best seen in FIGS. 2-6, the rail system 30 includes an elongate, upper rail section 32 and an elongate lower rail section 34. The front or distal end of the rail system 30 can be provided with resilient bumpers 38 to protectively support the front of the projectile launcher 10 during the cocking operation while the projectile launcher 10 is braced at its distal end against another object or the ground. The upper rail section 32 slidably supports a stirrup carriage 120 for the projectile B, while the lower rail section 34 slidably supports a cocking pawl carriage 41 for cocking the projectile launcher 10. Each rail section 32, 34 is preferably constructed from elongate square or rectangular tubes, one or both rail sections 32, 34 being complete or partial tubes, "partial" being construed as a channel having a C-shaped cross section. An elongate slot 33 is formed along the top length of the upper rail section 32 and serves as a flight groove for the projectile B. The slot 33 widens at the distal end of the upper rail section 32 in order to accommodate the head or tip of the projectile B. Although the widened section of the slot 33 is shown as a square or rectangular cutout, this section can be of any shape capable of permitting the tip of the projectile B to rest therein. The slot 33 also facilitates operation of a component of the cocking mechanism 40, which will be further described below.

The slot 33 preferably extends the whole length of the upper rail section 32. Alternatively, the extension of the slot 33 can stop short near the proximal end of the rail section 32. Any slot length can serve, so long as it provides proper support for the projectile B and permits operation of the cocking mechanism 40.

Figure 3:
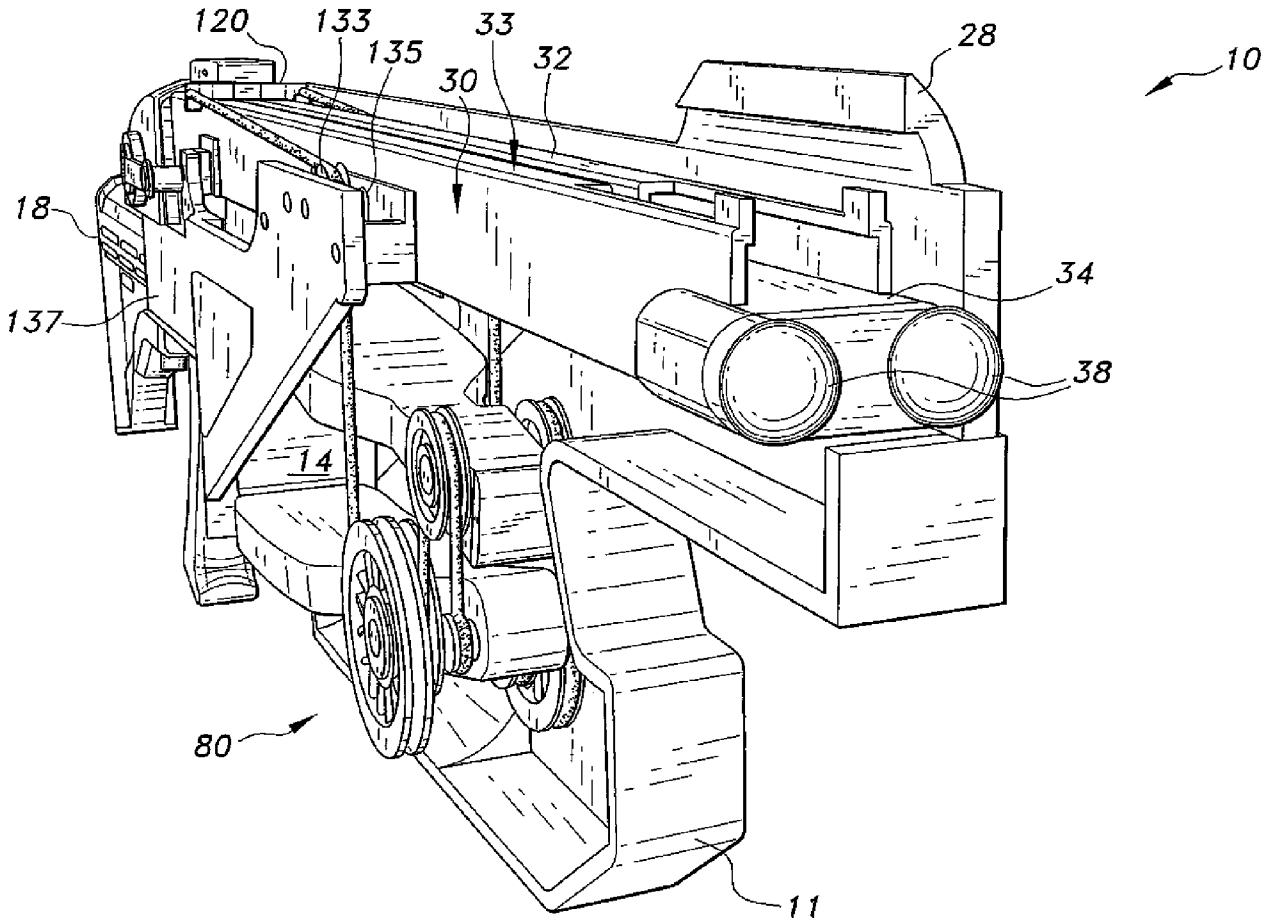
FIG. 3 is a perspective view of the projectile launcher of FIG. 2 as shown from the front and with part of the side housing removed to show details thereof.
Figure 5:
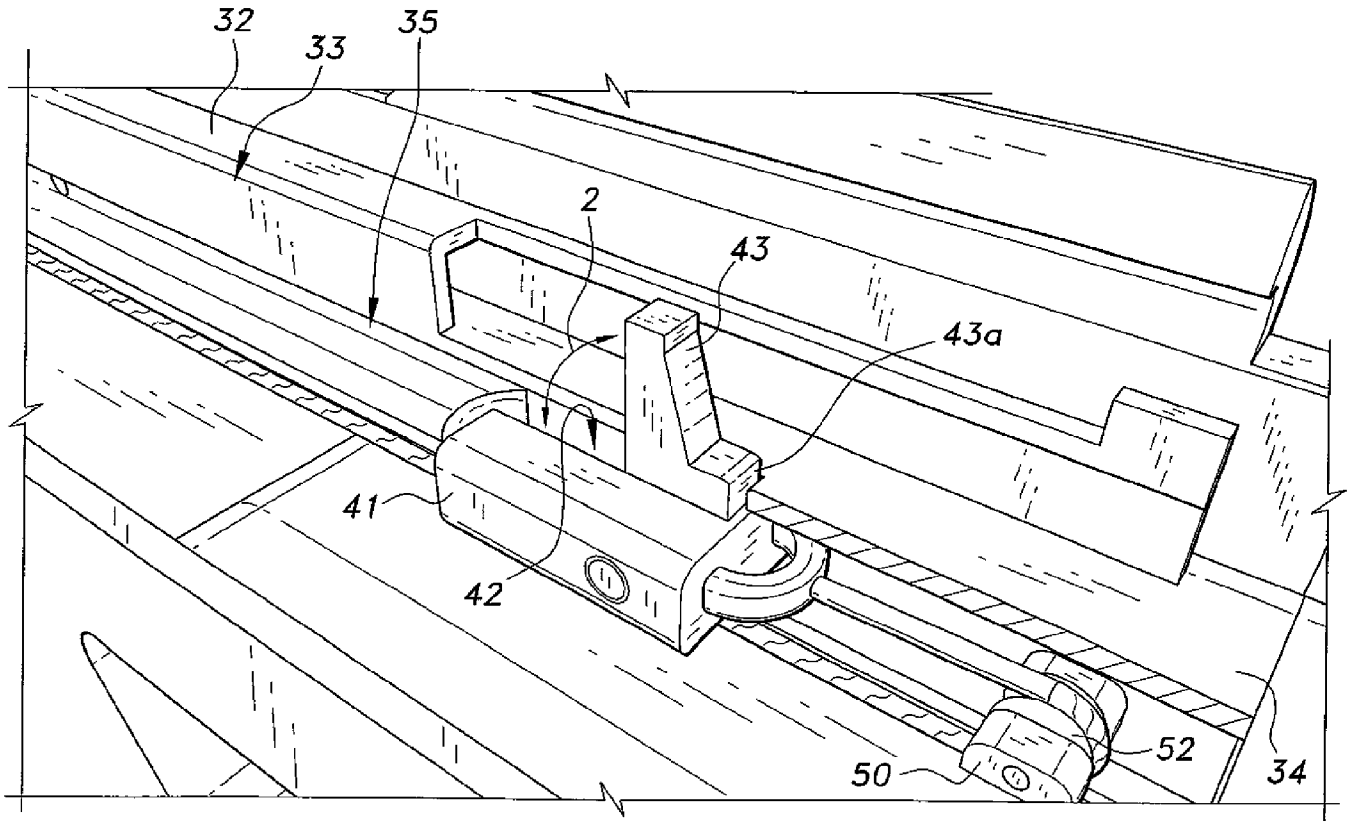
FIG. 5 is an enlarged partial perspective view of the front end of the projectile launcher of FIG. 2, shown with part of the side housing and rail system removed, showing details of the pawl of the cocking mechanism.
Figure 6:
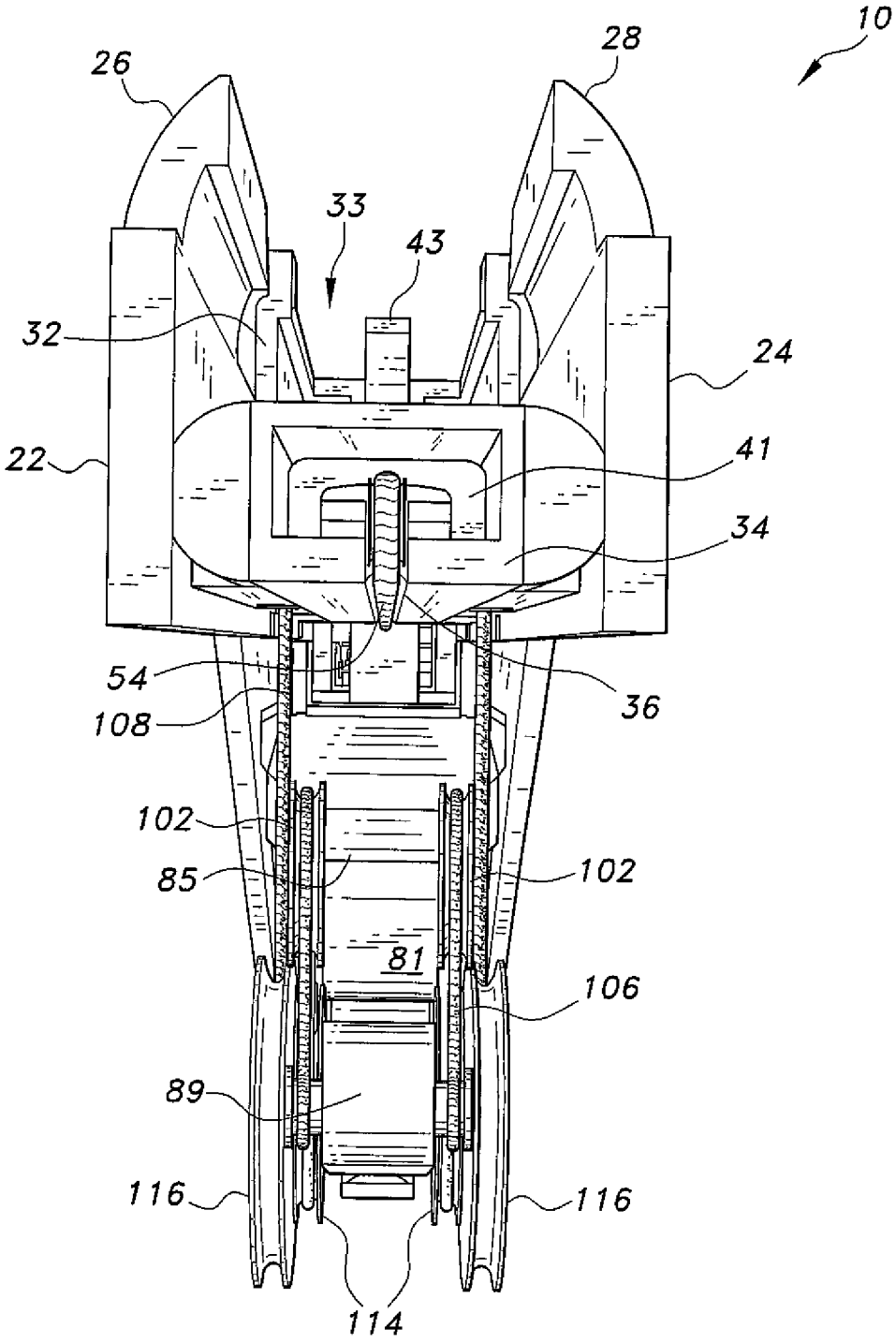
FIG. 6 is a front perspective view of the projectile launcher of FIG. 2, shown with part of the front housing removed.

As best seen in FIGS. 3 and 5, the interior edge of the slot 33 is preferably smooth and rounded to prevent any increased frictional engagement of the shaft when the projectile B is loosed. A non-smooth edge can potentially snag on the projectile B, reducing much of the energy imparted for flight. In the same vein, the surfaces of the slot 33 and/or the top surface of the upper rail section 32 can also be provided with a coating or a layer of friction-reducing material, such as Teflon® (Teflon is a registered trademark of E.I. Du Pont de Nemours and Company of Wilmington, Del.) and the like, in order to maximize the kinetic energy of the projectile B.

The top panel or portion of the lower rail section 34 also includes an elongate slot 35 collinear and parallel with the slot 33. The hollow interior of the lower rail section 34 accommodates slidable movement of a cocking pawl carriage 41, and the cocking pawl 43 in the pawl carriage 41 extends through both the slot 35 and the slot 33 to selectively engage the stirrup carriage 120 during the cocking operation.

Figure 7:
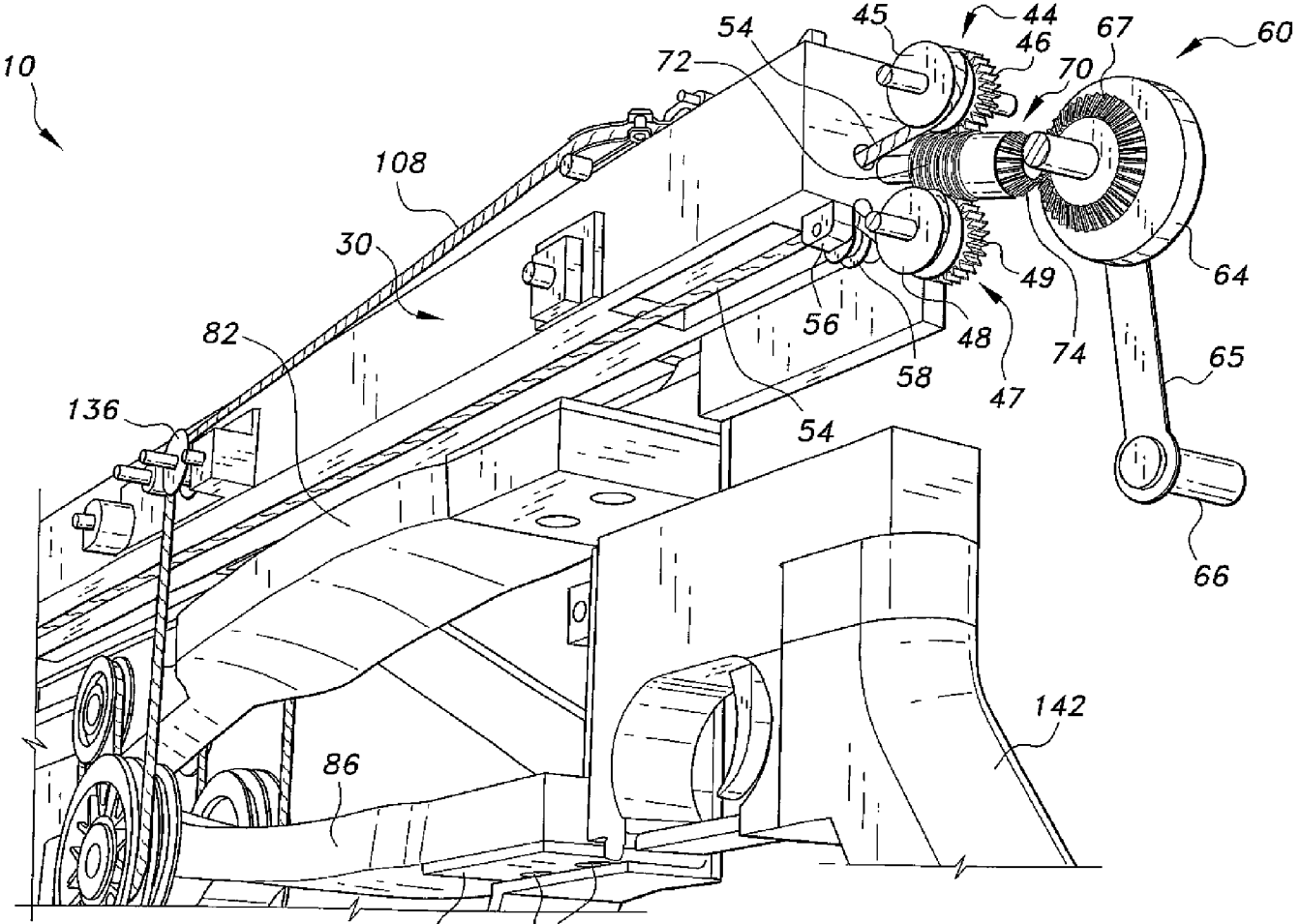
FIG. 7 is a rear perspective view of the projectile launcher of FIG. 2, shown with the side housing, riser base, and a portion of the trigger mechanism removed to highlight the crank mechanism.

The cocking mechanism 40 for the projectile launcher 10 includes a crank mechanism 60 mounted to the proximal end of the rail system 30 and the reciprocating cocking pawl carriage 41. A crank housing 62 encloses the working components of the crank mechanism 60. As best seen in FIG. 7, the crank mechanism 60 includes a crank 64 rotatably mounted to the crank housing 62. An elongate crank arm 65 is pivotally attached to one side of the crank 64 at one end, and a handle 66 protrudes transversely from the other end. The crank arm 65 is preferably constructed as an elongate plate, and the handle 66 is preferably shaped as an elongate, cylindrical post either rotatably mounted or non-rotatably fixed to the distal end of the crank arm 65. By this hinged construction of the crank arm 65, both the handle 66 and the crank arm 65 can be pivoted between use and non-use positions, where the former position extends the crank arm 65 radially outward, providing leverage for manual rotation, and the latter position stows the handle 66 into a corresponding hole on the side panel 22 when not in use. It is noted that either side panel 22, 24 or similar covering can be provided, with a hole, depending on user preference, i.e., right- or left-hand operation. The pivoting crank arm 65 arrangement adds to the compact, streamlined form factor for the projectile launcher 10.

The opposite side of the crank 64 includes a coaxial bevel gear 67. This bevel gear 67 interacts with an elongate transmission gear assembly 70. The transmission gear assembly is preferably constructed as a substantially elongate post having a combination of gears formed thereon. One end of the transmission gear assembly 70 is rotatably mounted to the back of the rail system 30 and includes an intermediate worm gear 72 along a majority of the length of the post, and a bevel gear 74 at the opposite end. The bevel gear 74 of the transmission gear assembly 70 meshes with the bevel gear 67 of the crank 64. Thus, rotation of the crank 64 facilitates simultaneous rotation of the transmission gear assembly 70.

The connection of the transmission gear assembly 70 to the back of the rail system 30 can be provided by a simple rotating connection or by other like means, e.g., a non-circular boss that can be inserted into a correspondingly shaped mounting recess or hole where the attached end of the transmission gear assembly 70 can rotate with respect the boss. This exemplary construction more securely mounts the transmission gear assembly 70 to the rail system 30. Other alternative constructions can also be utilized, such as a biased locking connection that permits removable mounting of the transmission gear assembly 70 while remaining free to rotate in response to the rotation of the crank 64. Additionally, a pair or more of the transmission gear assemblies 70 can be provided for ease of operation and/or increased mechanical advantage.

The cocking mechanism 40 also includes a first or upper pulley assembly 44 rotatably mounted inside the crank housing 62 above the transmission gear assembly 70, and a second or lower pulley assembly 47 rotatably mounted inside the crank housing 62 below the transmission gear assembly 70. Each pulley assembly is constructed as a combined, integral component having a pulley wheel coaxial with a gear. The pulley wheel can also be referred to as a pulley roller. Thus, the upper pulley assembly 44 includes a first or upper pulley wheel 45 integrally connected to a first or upper gear 46, while the lower pulley assembly 47 includes a second or lower pulley wheel 48 integrally connected to a second or lower gear 49. Each gear 46, 49 meshes with the worm gear 72 on the transmission gear assembly 70, and rotation of the worm gear 72 causes the upper and lower gears 46, 49 to concurrently rotate in opposite directions. In other words, when the upper gear 46 rotates clockwise via rotation of the worm gear 72, the worm gear 72 causes the lower gear 49 to simultaneously rotate counterclockwise, and vice versa.

One end of a cocking cable 54 is anchored to each upper pulley wheel 45 and lower pulley wheel 48. Both ends extend through corresponding holes at the back of the rail system 30 to wind around respective upper and lower pulley wheels 45, 48 as best seen in FIG. 7. Rotation of the upper and lower pulley wheels 45, 48 simultaneously winds and unwinds the cocking cable 54. The cocking pawl carriage 41 is attached to the cocking cable 54 at an intermediate section thereof and forced to move in response to the winding and rewinding rotations of the upper and lower pulley wheels 45, 48 on the cocking cable 54. Since the cocking pawl carriage 41 is slidably mounted inside the channel of the lower rail section 34, the cocking pawl carriage 41 is confined to reciprocate therein.

To facilitate the reciprocating movement of the cocking pawl carriage 41, the cocking cable 54 is trained around a distal, first idle pulley wheel or roller 52 rotatably mounted to a first mounting block 50 at the distal end of the lower rail section 34 and a proximal, second idle pulley wheel or roller 58 rotatably mounted to a second mounting block 56 at the proximal end of the lower rail section, as best shown in FIGS. 4-7. For simplicity of description, the trained arrangement of the cocking cable 54 is described as beginning from the upper pulley wheel 45. From the upper pulley wheel 45, a section of the cocking cable 54 extends into the channel of the lower rail section 34 and is attached to one end of the cocking pawl carriage 41. The remaining section of the cocking cable 54 extends from the other end of the cocking pawl carriage 41 and trains around the first idle pulley wheel 52 and the second idle pulley wheel 58 to connect with the lower pulley wheel 48. In order to insure proper movement of the cocking cable 54 during use, the bottom panel or wall of the lower rail section 34 can include an elongate guide groove 36 for guiding and defining the path of the cocking cable 54 to and from the lower pulley wheel 48. The guide groove 36 also assists in preventing fraying or damage to the cocking cable 54.

The cocking pawl carriage 41 includes an elongate, rectangular block having a recess 42 and a biased cocking pawl 43 pivotally mounted within the recess 42. The cocking pawl 43 can be constructed as an elongate, wedge-shaped bar normally biased to the upstanding position, as best seen in FIG. 5. The cocking pawl 43 includes an abutment extension **43*a* constructed to interact with the slot 35 in the lower rail section 34. The surfaces of the cocking pawl carriage 41 and/or the interior surfaces of the channel in the lower rail section 34** can be provided with a coating or layer of friction reducing material, such as Teflon, in order to insure smoothness and ease of sliding movement.

In use, the projectile launcher 10 is placed so that the bumpers 38 at the front of the projectile launcher 10 rest on the ground or any suitable bracing surface or object. The cocking pawl 43 normally extends upright so that operation of the crank mechanism 60 in one direction slides the cocking pawl carriage 41 until the cocking pawl 43 engages the front of the projectile stirrup carriage 120. Continuous cranking causes the cocking pawl 43 to push the stirrup carriage 41 towards the rear or proximal end of the barrel assembly 20 until the stirrup carriage 120 is in the fully cocked position. At this point, the projectile stirrup carriage 120 is locked in place by, e.g., releasable catches or fingers 146 of the trigger assembly 140. Prior to releasing the catches 146, the crank mechanism 60 is rotated in the opposite direction, causing the cocking pawl carriage 41 to slide back towards the front or distal end of the barrel assembly 20. Towards the end of the backwards travel, the abutment extension 43*a* abuts against the end of the slot 35, forcing the cocking pawl 43 to pivot clown into the recess 42, as indicated by the arrow 2 in FIG. 5. This allows the cocking pawl 43 to clear the slot 33 in the upper rail section 32, permitting unobstructed placement and passage of the projectile B to be loosed. At least this end of the slot 35 is preferably closed to facilitate the abutted pivoting motion of the cocking pawl 43. However, this end of the slot 35 can also be constructed in a variety of shapes, such as the end having sloping sides, a stepped end portion, and the like that provide some sort of obstruction for interacting with the abutment extension 43*a*.

Figure 4:
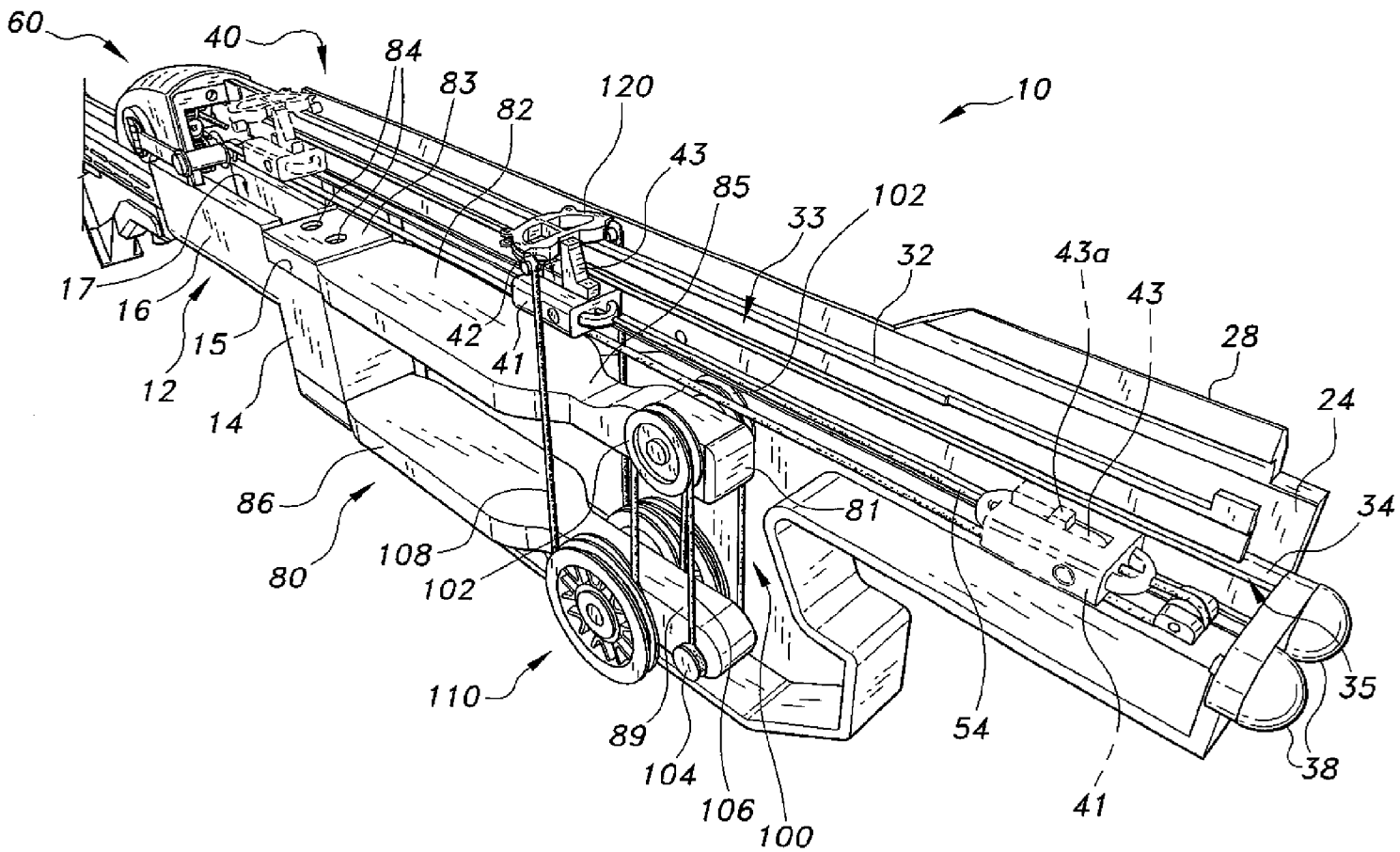
FIG. 4 is a partial perspective view of the projectile launcher of FIG. 2, shown with the side housing and part of the rail system removed.
Figure 8:
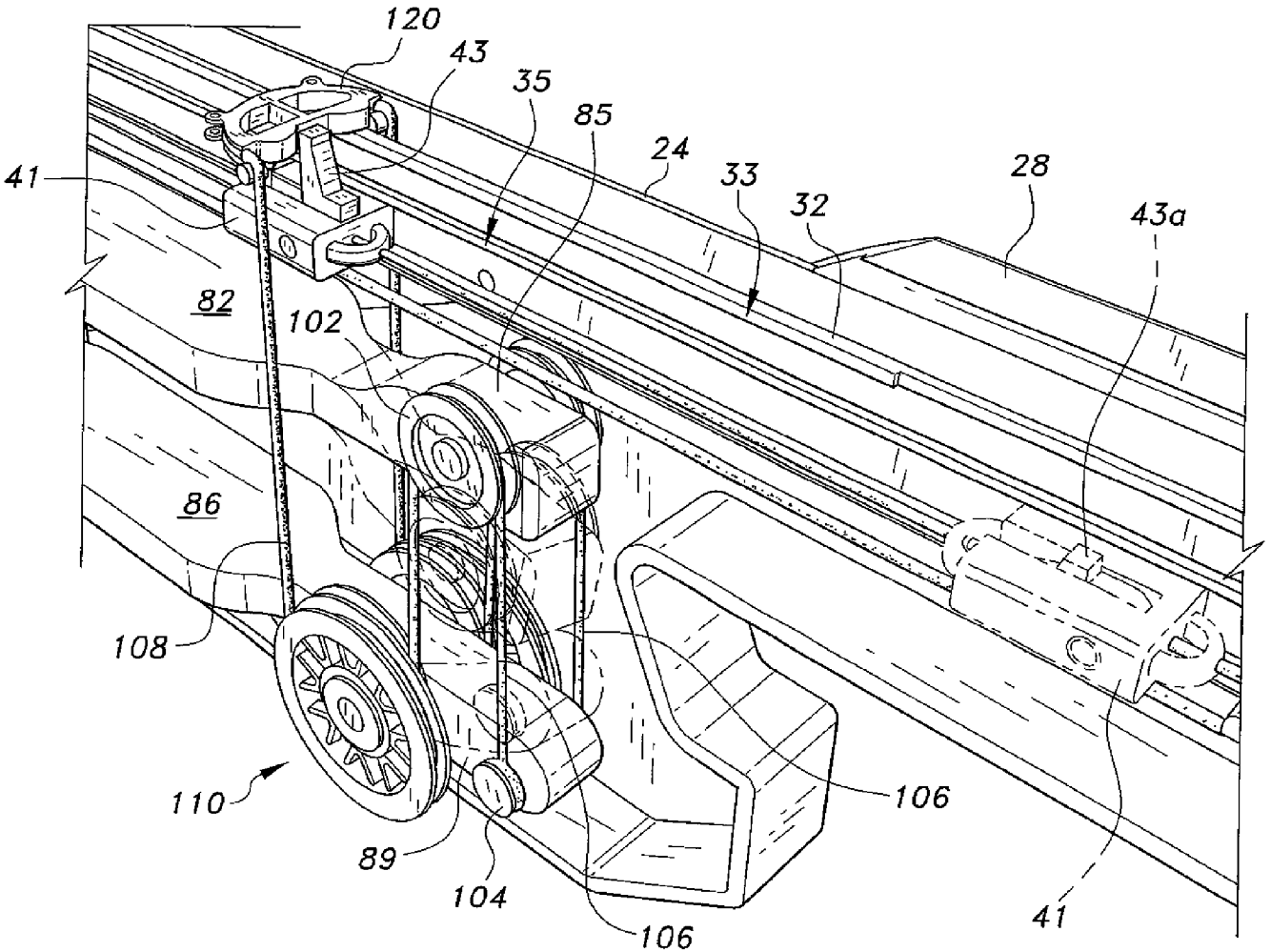
FIG. 8 is a partial perspective view of the projectile launcher of FIG. 2, showing details of the internal bow limbs and the cocking mechanism.

The kinetic energy for propelling the projectiles B is provided by a bow assembly 80 attached to the riser base 12. The term "bow assembly" is used because it includes bow elements that tension connected cables and transfer the energy stored therein to accelerate the projectile B in a manner similar to various archery weapons. Unlike conventional crossbows, the bow assembly 80 is configured in a reversed and vertical orientation as opposed to front-facing and horizontal. Moreover, the projectile launcher 10 is provided with a covering 11 that encloses the bow assembly 80 and associated components, which protects the bow assembly 80 from the elements and provides a safety feature for the user. Any noise that may be generated by the operation of the bow assembly 80 will also be muffled by the covering 11. This configuration of the bow assembly 80 provides the projectile launcher 10 with a compact, streamlined form, which eliminates the potential hindrances of horizontally extending bow arms in conventional crossbows. As shown in FIGS. 4, 7 and 8, the bow assembly 80 includes a flexible, resilient upper bow arm, limb or lath 82 attached to the mounting ledge 15 on the vertical short section 14, and a flexible, resilient lower bow arm, limb or lath 86 attached to the bottom of the short section 14.

The upper bow arm 82 is constructed as an elongate, flat beam having one end secured to the mounting ledge 15 by an upper mounting plate 83 and bolts 84. The upper bow arm 82 includes a relatively wide section that tapers to a relatively short, narrow section 85.

Similarly, the lower bow arm 86 is constructed as an elongate, flat beam having one end secured to the bottom of the short section 14 by a lower mounting plate 87 and bolts 88. The lower bow arm 86 includes a relatively wide section that tapers to a relatively short, narrow section 89. Although both the upper and lower bow arms 82, 86 include wide and narrow sections, the bow arms 82, 86 are not identically shaped due to the bow flexing assembly 100 attached to the narrow sections 85, 89. However, the different width sections are generally preferred for each bow arm 82, 86, where the wide section provides the durability and strength for flexure and the narrow section eases flexing of the bow arms 82, 86. Alternative constructions, such as a beam with continuous tapering sides and the like, can also be used for similar purpose. In general, the sizes and shapes of the upper and lower bow aims 82, 86 can be selected in concert with the flexing assembly 100 configuration and mass distribution to create the required energy storage and minimized center of mass shifts during firing, as described more below. Thus and alternatively, identical upper and lower bow arms 82, 86 can be employed with corresponding accommodation of the flexing assembly 100.

Figure 9:
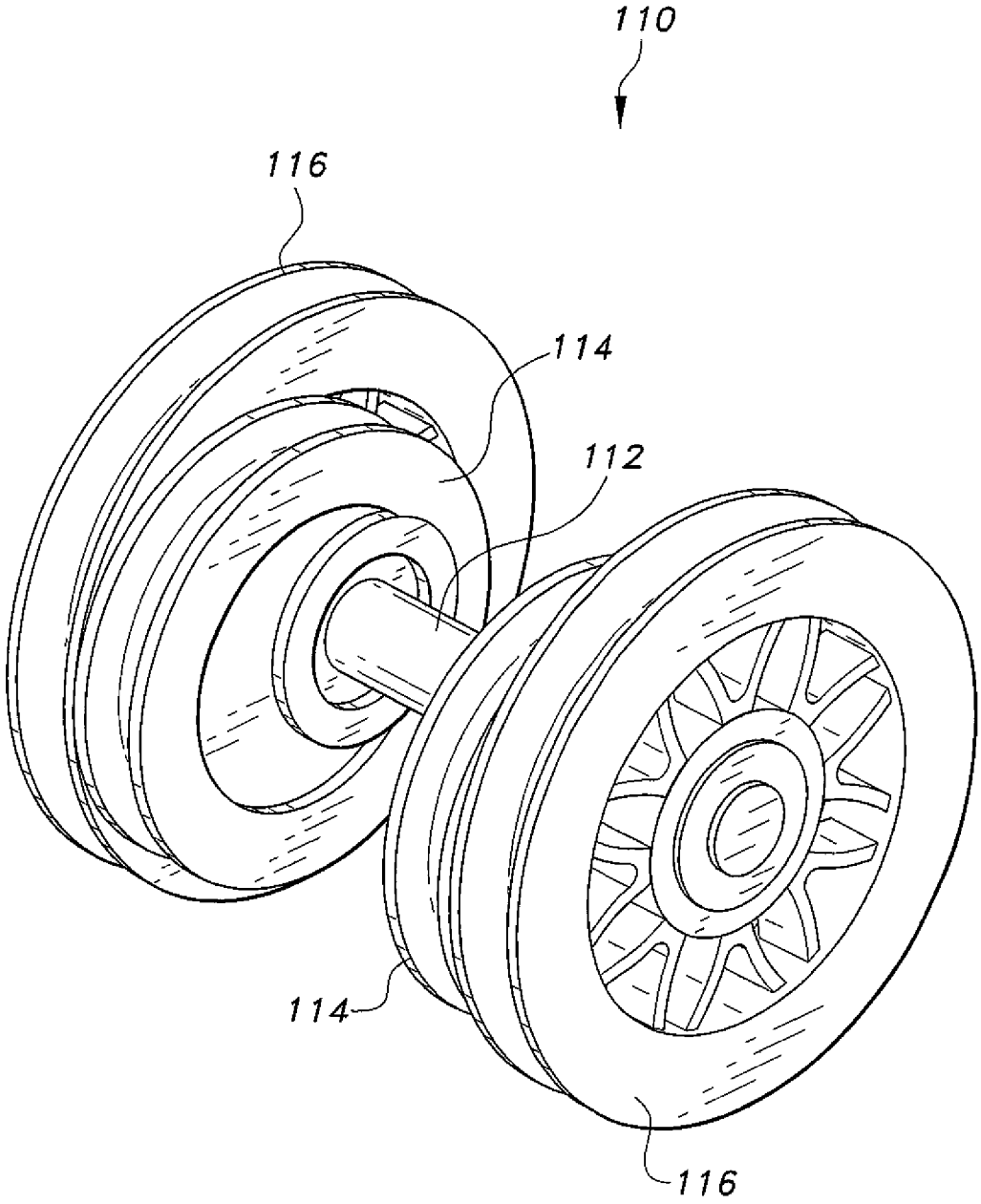
FIG. 9 is a perspective view of a cam pulley wheel assembly for the projectile launcher of FIG. 2.

The flexing assembly 100 includes a pair of outer, upper pulley wheels or rollers 102 rotatably mounted near the distal end of the upper narrow section 85 and a cam pulley assembly 110 rotatably mounted to the lower narrow section 89. The cam pulley assembly 110 (best seen in FIG. 9) includes a rotatable shaft 112, a pair of inner pulley wheels or rollers 114 and a pair of outer pulley wheels 116. The inner pulley wheels 114 are rigidly attached to the shaft 112 at an offset or eccentric axis. When assembled, the inner pulley wheels 114 reside on the sides of the lower narrow section 89. Each inner pulley wheel 114 has a given, preselected diameter. Each outer pulley wheel 116 is coaxially mounted to respective ends of the shaft 112 adjacent to respective inner pulley wheels 114. The diameter of the outer pulley wheels 116 is preferably larger than the inner pulley wheels 114. Due to the eccentric axial mounting of the inner pulley wheels 114, rotation of the outer pulley wheels 116 causes a corresponding cam rotation of the inner pulley wheels 114. Unlike a traditional compound crossbow mechanism that has analogous but loosely synchronized pairs of inner and outer pulley wheels, the rigid attachment of the inner and outer pulley wheels 114, 116 to the shaft 112 ensures that rotational synchronization of the flexing assembly 100 is maintained at all times, which improves shooting accuracy by ensuring consistent tensioning of the attached cables for firing the projectile B.

Each pair of inner and outer pulley wheels 114, 116 can be constructed as separate components. However, they are preferably integrally fixed to each other by some means, such as fasteners or adhesive, in order to preserve the desired camming effect. A more preferred construction includes a molded or machined pair of inner and outer pulley wheels 114, 116. The wheels preferably include a plurality of cutouts to minimize weight and rotational inertia.

The flexing assembly 100 is also provided with a pair of first flex cables 106. Each first flex cable 106 is anchored at one end to an anchor stub 104 disposed on the sides of the lower narrow section 89 at the end thereof. The remainder trains over the upper pulley wheels 102 and down towards the lower, inner pulley wheels 114, where the opposite end of the respective first flex cable 106 anchors thereon. A second flex cable 108 has each end anchored to respective outer pulley wheels 116 of the cam pulley assembly 110. The second flex cable 108 extends from one outer pulley wheel 116 and trains around the projectile stirrup carriage 120 to the other outer pulley wheel 116. Alternatively, the second flex cable 108 can be provided as two equal length cables with each being anchored to a respective outer pulley wheel 116 at one end and the other end anchored to a corresponding side of the stirrup carriage 120. The interaction between the flex cables and the pulley wheels flexes the bow arms 82, 86 to be further described below.

Figure 10:
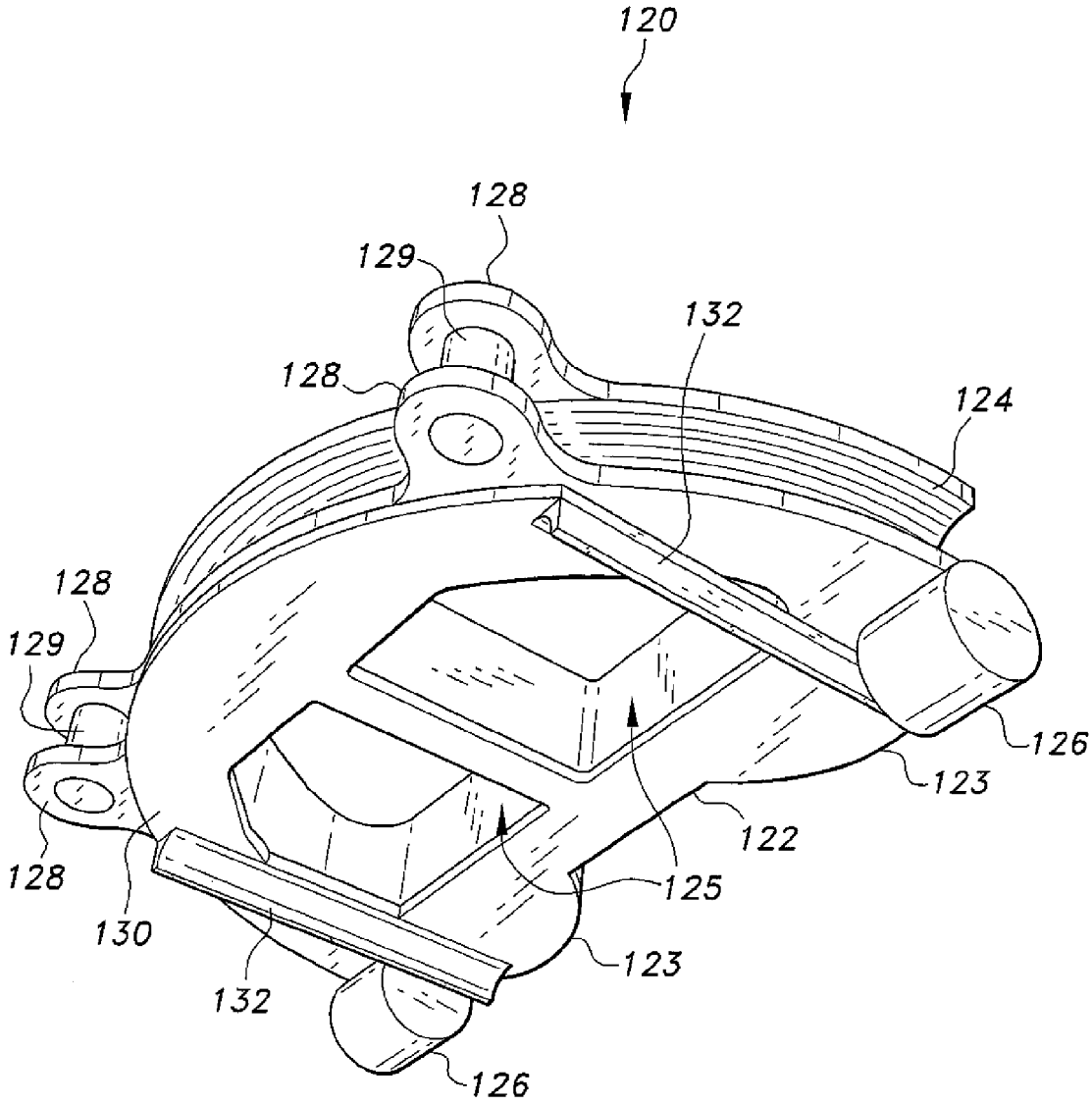
FIG. 10 is a bottom perspective view of a stirrup carriage for the projectile launcher of FIG. 2.
Figure 11:
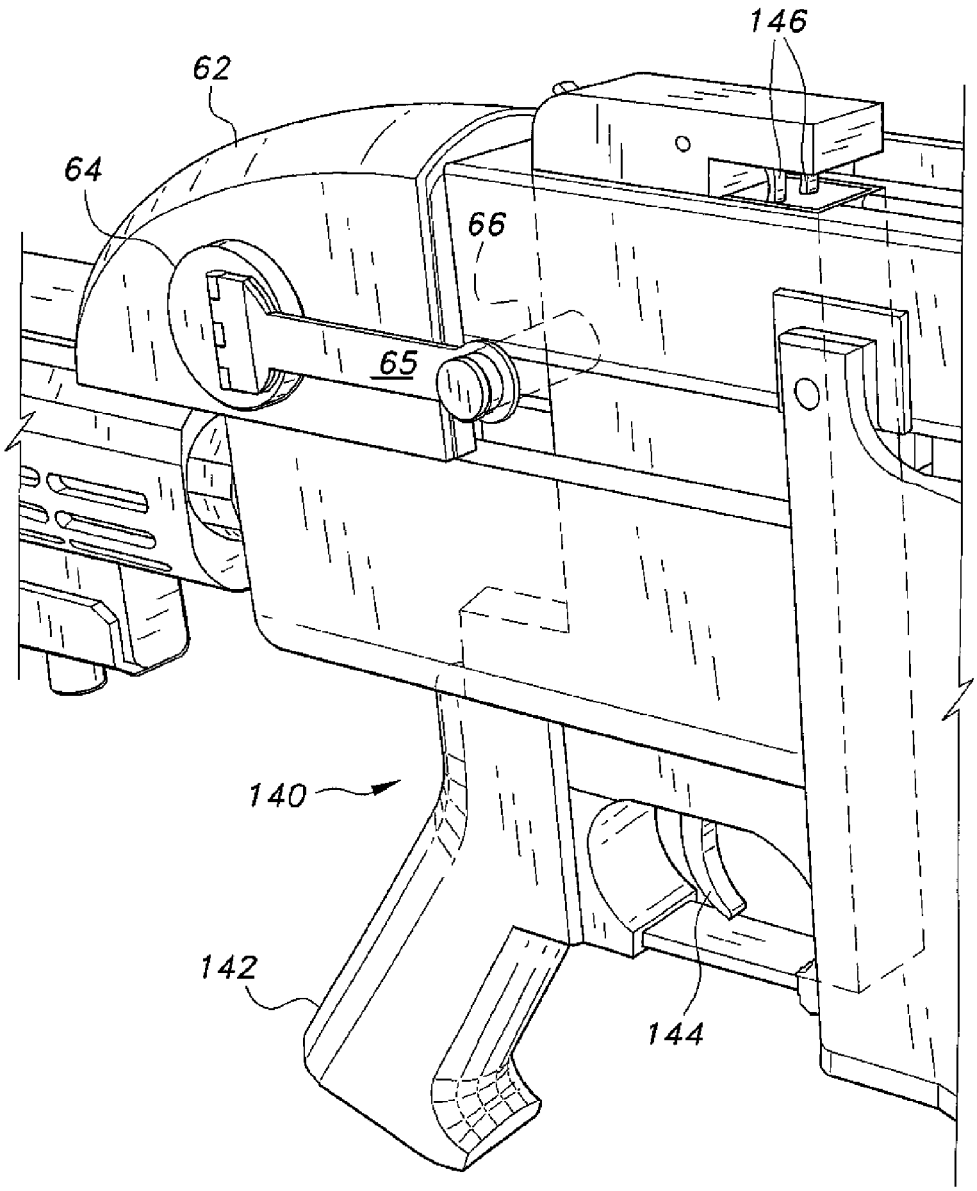
FIG. 11 is a partial perspective view of the projectile launcher of FIG. 2, showing the crank for the cocking mechanism.

The projectile stirrup carriage 120 is best shown in FIG. 10. As shown, the projectile stirrup carriage 120 is constructed as a relatively thin, hemi-circular block with a relatively flat front 122 and a curved or arcuate outer edge. The front 122 includes a flat portion for accommodating the cocking pawl 43 during the cocking operation. Additionally, the flat portion serves as an abutment for the back of the projectile B when the projectile launcher 10 is ready to be fired. A completely flat front may be serviceable, but to insure safe operation, the stirrup carriage 120 can include a pair of outwardly projecting front guide protrusions 123, with the flat portion disposed therebetween. The guide protrusions 123 assist in insuring proper placement of the rear end of the projectile B and prevent lateral movement thereof. Any lateral play that may exist with respect to the operation of the cocking pawl 43 will also be prevented by the guide protrusions 123. Additionally, the guide protrusions 123 provide increased longitudinal support to prevent the projectile stirrup carriage 120 from tumbling during high accelerated travel along the upper rail section 32. The projectile stirrup carriage also includes a pair of cutouts 125 for receiving the catches 146 of the trigger assembly 140 as well as to minimize weight.

A guide groove 124 is formed along the curved outer edge, upon which the second flex cable 108 trains around the stirrup carriage 120 and is connected thereby. In order to secure the trained connection, the stirrup carriage 120 includes a pair of guide roller stubs 126 and two pairs of angularly spaced, radially projecting support tabs or extensions 128, each pair of support tabs 128 supporting a guide roller 129 therebetween. The guide roller stubs 126 can be constructed as non-rotating cylindrical stubs disposed at the bottom of the stirrup carriage 120 on opposite ends of the substantially flat front 122. Alternatively, the guide roller stubs 126 can be rotatable. Each pair of support tabs 128 includes an upper and lower support tab, the guide roller 129 being mounted between the tabs. As with the guide roller stubs 126, the guide roller 129 can be rotatable or non-rotatable. Any number of pairs of support tabs 128 can be provided for the stirrup carriage 120. In use, the second flex cable 108 trains around the guide roller stubs 126 into the guide groove 124, where the guide roller 129 traps the second flex cable 108 and prevents any unintentional dislodging of the flex cable 108.

Since the projectile stirrup carriage 120 is configured to slide along the top of the upper rail section 32 at varying speeds, the projectile stirrup carriage 120 is also provided with a wear plate 130 at the bottom of the carriage 120. Preferably, the wear plate 130 is constructed from friction-reducing material to increase longevity and operational effectiveness for transferring kinetic energy to the projectile B. A pair of guide rails 132 extends from opposite, lateral ends of the wear plate 130. These guide rails 132 straddle the lateral sides of the upper rail section 32 and ensure that the projectile stirrup carriage 120 travels along the upper rail section 32. The top of the upper rail section 32 can also be provided with a coating or layer of friction reducing material.

In order to redirect the vertical force created by the bow assembly 80 working with the flex assembly 100 and transmitted via the second flex cable 108 into a horizontal force applied to the projectile stirrup carriage 120, the projectile launcher 10 also includes a plurality of side idler guide rollers 133, 136 rotatably mounted between the rail system 30 and rail system support frame 137 that projects from and is attached to the short vertical section 14. The second flex cable 108 is confined between the guide rollers 133, 136, which ensure that only a portion of the second flex cable 108 deflects between the longitudinal ends of the rail system 30.

The trigger assembly 140 includes a detachably mounted block having a grip 142, a trigger 144, and a pair of catches or fingers 146 disposed near the top of the block. The trigger assembly extends through the slot 17 of the rail system 30, and the releasable catches 146 engage the cutouts 125 when the stirrup carriage 120 is in the cocked position. Pulling the trigger 144 releases the catches 146. The top of the trigger assembly 140 or the crank housing 62 can be provided with a mounting system (not shown) for mounting scopes and other similar sights to assist aim.

In operation, the cocking pawl 43 pushes the stirrup carriage 120 back towards the trigger assembly 140 against the resistance of the second flex cable 108. The movement of the stirrup carriage 120 causes the second flex cable 108 to pull away from the outer pulley wheels 116, thereby rotating the same. Rotation of the outer pulley wheels 116 simultaneously rotates the inner pulley wheels 114. This action winds the first flex cables 106 around the inner pulley wheels 114, forcing the upper and lower narrow sections 85, 89 of the upper and lower bow arms 82, 86 to flex toward each other. At this point, the projectile stirrup carriage 120 is cocked and ready to be released. Upon release of the catches 146 by the user pulling the trigger 144, the built-up tension in the second flex cable 108 is released causing the projectile stirrup carriage 120 to rapidly accelerate along the upper rail section 32 towards the front thereof. This action launches the projectile B carried by the projectile stirrup carriage 120.

Unlike modem conventional crossbows, the projectile launcher 10 can be dry-fired without risk of damage to the bow assembly 80 due to the mass of the projectile stirrup carriage 120. If a user dry-fires such a conventional crossbow, the kinetic energy transfers back into the bowstring and the various components of the crossbow, rather than to the bolt. With some crossbows having a draw weight in the hundreds of pounds, that is a considerable amount of energy to be absorbed. This leads to potential damage, such as breaks in the bow limbs and/or bowstring, failure or breakage in the cams and pulleys, etc., which can potentially result in flying parts that can harm the user. In contrast, the mass of the projectile stirrup carriage 120 acts as a focus for dissipating the released energy as it travels towards the front of the rail system 30 past the normal position at the midpoint of the rail system 30 and decelerates at the end of the firing cycle. In other words, the momentum of the projectile stirrup carriage 120 towards the end of travel, i.e., the distal end of the rail system 30, pulls against or counteracts the natural rebounding flexure of the bow arms 82, 86, thereby dissipating the potential energy after firing. While benefiting dry-firing conditions, this effect occurs to a lesser degree in normal firing conditions. The stirrup carriage 120 will still overrun its normal midpoint position when firing a projectile B, and any residual energy will be dissipated by the overrun. This overrun of the bolt stirrup carriage 120 at the completion of firing also has the effect of eliminating vibration in the second flex cable 108, which can generate unwanted noise. Thus, an extremely quiet operation can be facilitated. The string/cable vibration at the end of firing in a traditional crossbow is more than an annoyance, and reduces the desired stealth of operation that is highly prized in hunting applications. It is noted that this anti-vibration effect occurs in both firing and dry-firing conditions.

The pulley system in the bow assembly 80 functions in a similar manner to conventional compound bows. The cam pulley assembly 110 allows the bow arms 82, 86 to be drawn and the draw to be maintained without continuous effort, as in non-compound bows. Depending on the desires or requirements of the user, the cam pulley assembly 110 and/or the upper, outer pulley wheels 102 can be constructed with various different cam profiles to facilitate the desired draw characteristics.

In addition, the bow arms 82, 86 have been mentioned as being not necessarily identical, as well as that the components of the flexing assembly 100 mounted onto the bow arms 82, 86 may be of generally different masses. Therefore, the aggregate center of mass of the combined bow assembly 80 and flexing assembly 100 may translate in the vertical plane during cocking and firing operation. In other words, the different configuration of the upper and lower bow arms 82, 86 and flexing assembly 100 mounting configuration could cause the releasing momentum to be directed at an angle from the aim line. In order to compensate, the combined bow assembly 80 and flexing assembly 100 are constructed to be dynamically balanced such that their aggregate center of mass is invariant in the vertical plane during cocking and firing operation. For example, the upper bow arm 82 can be provided with a weighted end 81 and/or larger cross section to the upper narrow section 85. In addition, the materials for constructing the bow arms 82, 86 can be selected and assembled to provide the desired flex and balance. Moreover, the masses of the upper pulley wheels 102, and inner and outer pulley wheels 114, 116 can be tuned by adjustment of thickness, size of cut-outs, etc. to create the desired mass distribution in combination with the aforementioned adjustments.

Thus, it can be seen that the projectile launcher 10 provides an unencumbered and easy to operate crossbow-like weapon in a significantly more compact and streamlined form. Since the working components of the projectile launcher 10 are enclosed or confined within a guarded or protected structure, the user can operate and fire the projectile launcher 10 without much of the safety and operational concerns of conventional crossbows. Moreover, the reversed and vertically oriented internal bow assembly 80 and associated structural support and the placement thereof results in a balanced weapon, enhancing portability, operation, and aim.

Figure 12:
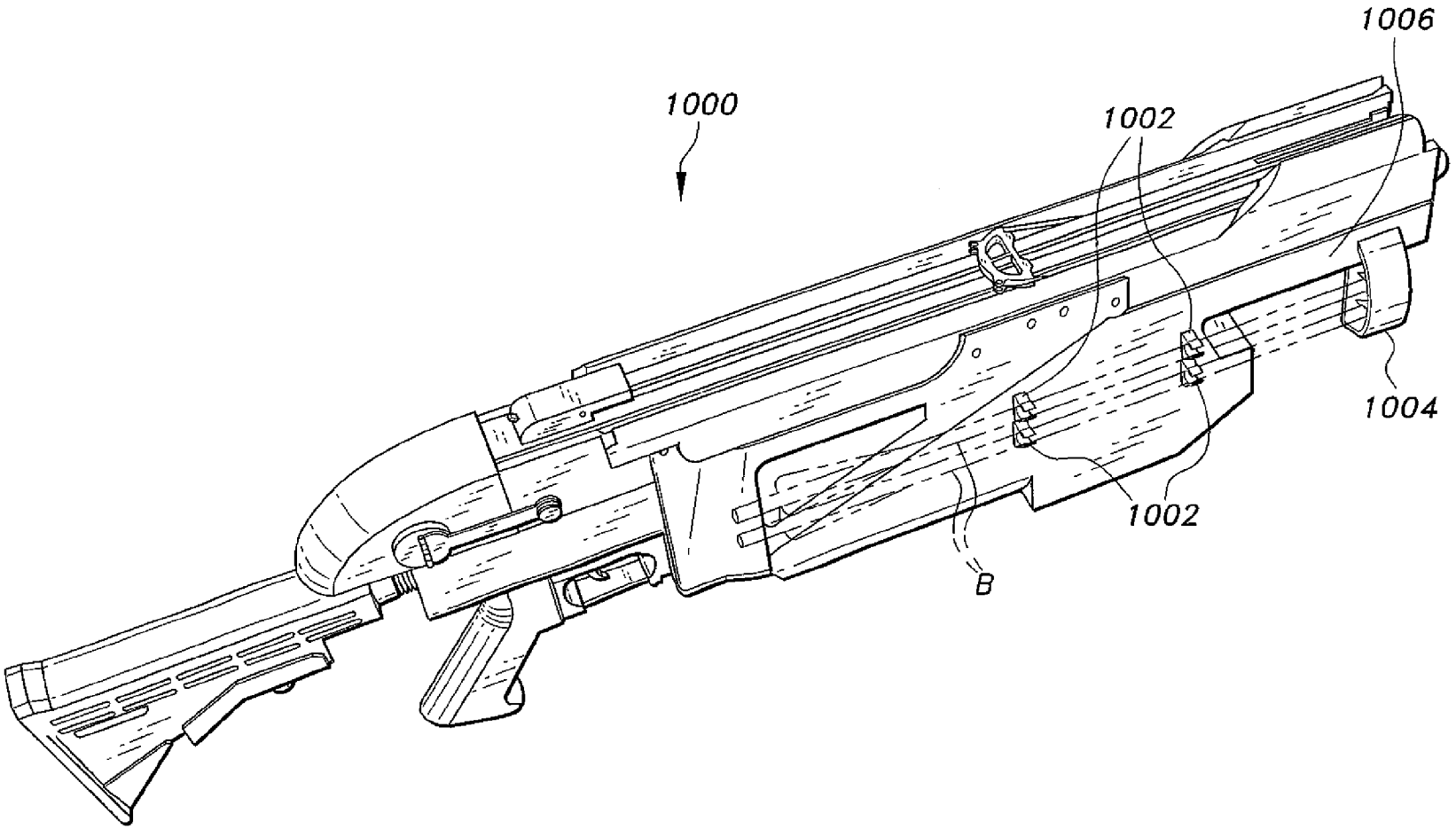
FIG. 12 is a top perspective view of an alternative embodiment of a projectile launcher according to the present invention having an integral quiver assembly.
Figure 13:
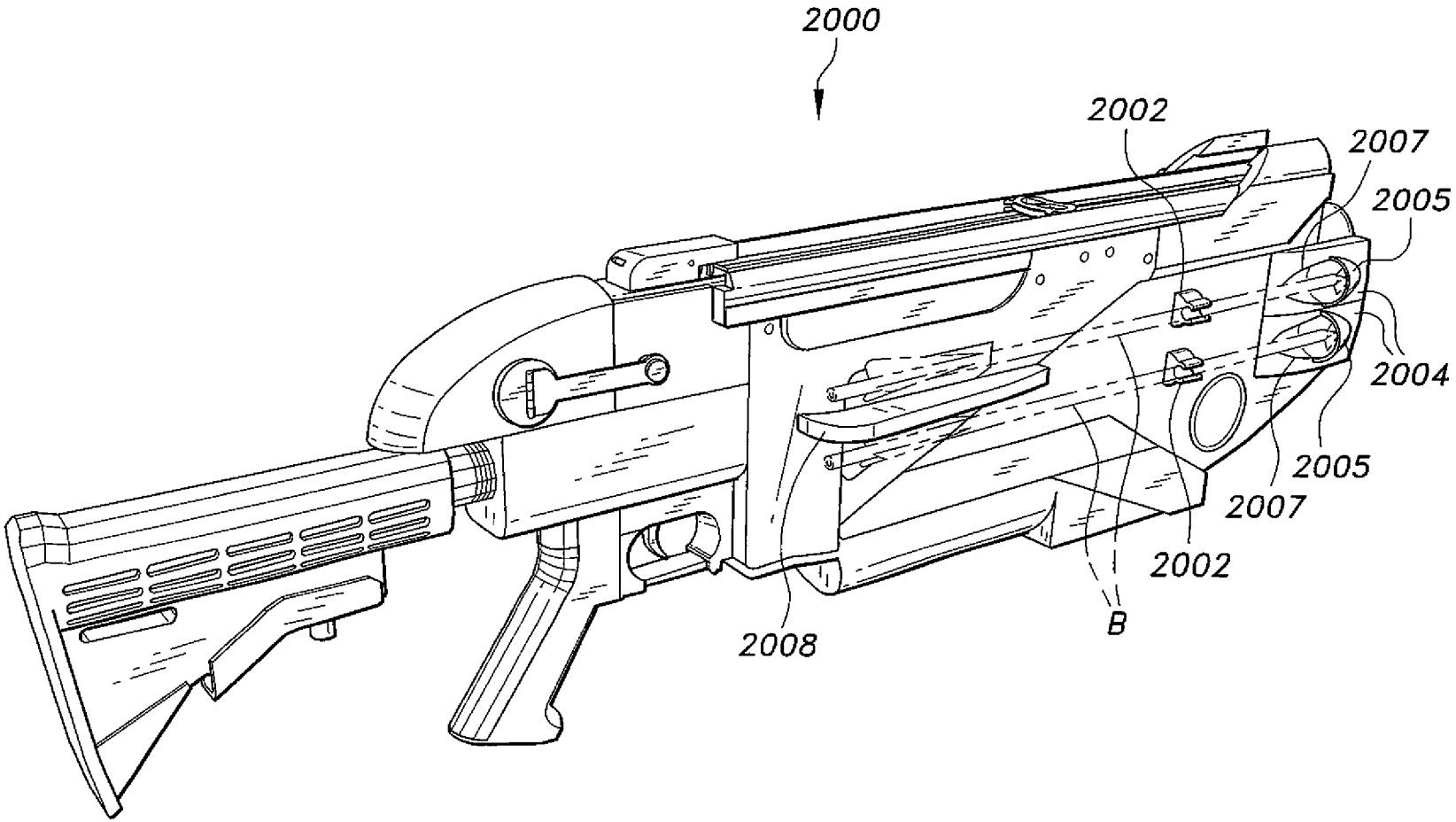
FIG. 13 is a top perspective view of another alternative embodiment of a projectile launcher according to the present invention having an integral quiver assembly.

Turning to FIGS. 12 and 13, these drawings show alternative embodiments having integral quivers. As shown in FIG. 12, the projectile launcher 1000 includes a plurality of spaced projectile clamps or grips 1002 disposed on the sides of the covering 1006. These projectile clamps 1002 permit projectiles B, such as a crossbow bolt, to be secured thereon. The front end of the projectile launcher 1000 also includes an integral projectile head guard 1004 hanging or depending therefrom. The projectile head guard 1004 is a housing that provides a protective cover for the crossbow projectile tip or head. In use, the user places the tip or head of the projectile B into the opening of the projectile head guard 1004 prior to securing the same to the clamps 1002.

As shown in FIG. 13, the projectile launcher 2000 includes a plurality of spaced projectile clamps or grips 2002 disposed on the sides of the covering 2006. These projectile clamps 2002 permit projectiles B, such as a crossbow bolt, to be secured thereon. The front end of the projectile launcher 2000 also includes an integral projectile head guard 2004 at the front end of the projectile launcher 2000. Each projectile head guard 2004 includes a curved cover 2005 overlaying a scalloped recess 2007. The scalloped recess 2007 provides room for receiving the tip or head of the projectile B, while the cover 2005 protects the same from the environment and the user. The projectile launcher 2000 can also include a fin 2008 disposed between adjacent projectiles B to assist in maintaining separation thereof and protecting the fletching from damage due to potential contact with the environment and user.

It is to be understood that the projectile launcher 10 encompasses a variety of alternatives. For example, the projectile launcher 10 can be constructed from a variety of durable materials, such as wood, plastic, metal, composites and combinations thereof. Additionally, while the upper and lower rail sections 32, 34 have been shown to be separate but integral components, both can be constructed as a single, unitary structure. The rail sections 32, 34 can also be provided in various shapes, so long as they can support the cocking operation. The cocking pawl carriage can also be sized and shaped accordingly to accommodate differently shaped rail sections 32, 34. Alternative gearing arrangements can be constructed for transferring the rotating crank motion into corresponding winding and reeling motion in the cocking mechanism 40. For example, the transmission gear assembly 70 and bevel gear 67 can alternatively be replaced by a simple gear fixed to the crank 64 and used in combination with a ratchet mechanism. Furthermore, various moving parts can be provided with or constructed from friction-reducing material. As mentioned previously, the projectile launcher 10, 1000, 2000 is capable of firing various types of elongate projectiles. Other types of projectiles such as pellets, balls, discs and the like can also be used with appropriate modifications to the stirrup carriage and/or the rail system to accommodate the shape.

It is to be understood that the present invention is not limited to the embodiments described above, but encompasses any and all embodiments within the scope of the following claims.

I claim:

1. A projectile launcher, comprising:

a riser base having a vertical section and a horizontal section extending perpendicularly from an end of the vertical section, the vertical section having a top and a bottom;

a barrel assembly attached to the riser base, the barrel assembly having an elongate rail system adapted for placement of a projectile, the rail system having a top, a bottom, a front, and a back;

a projectile stirrup carriage slidably engaged with the top of the rail system, the projectile stirrup carriage being adapted for supporting the back of the projectile for selective release thereof;

a cocking mechanism slidably mounted to the rail system, the cocking mechanism having a cocking pawl carriage selectively engageable with the projectile stirrup carriage for cocking the projectile stirrup carriage;

a bow assembly attached to the riser base, the bow assembly being oriented reversed and vertically, the bow assembly having at least one flex cable trained on the projectile stirrup carriage, the bow assembly being flexed when the projectile stirrup carriage is moved to a cocked position, the bow assembly accelerating sliding movement of the projectile stirrup carriage when the carriage is released from the cocked position in order to fire the projectile;

a crank mechanism attached to the rail system, the crank mechanism selectively reciprocating the cocking carriage; and a trigger assembly attached to the riser base, the trigger assembly selectively catching and releasing the projectile stirrup carriage.

2. The projectile launcher according to claim 1, wherein said cocking pawl carriage comprises a base having an elongate recess and an elongate, biased cocking pawl pivotally mounted in the recess, the cocking pawl being normally biased upright so that a portion of the cocking pawl extends above the top of the rail system.

3. The projectile launcher according to claim 2, wherein said rail system comprises an elongate upper rail section and an elongate lower section, the upper rail section having an elongate slot for placement of the projectile and passage of the cocking pawl, the lower rail section having an elongate slot and a channel, said cocking pawl carriage being slidably mounted in the channel, said cocking pawl extending through the slot in the lower rail section and the slot in the upper rail section.

4. The projectile launcher according to claim 3, wherein said crank mechanism comprises:

a crank housing attached to the back of said rail system;

a crank rotatably mounted to the crank housing, the crank having a gear on one side inside the crank housing;

an elongate crank arm having one end pivotally attached to the crank;

a handle attached to the other end of the crank arm, the handle extending orthogonal to the crank arm, the crank arm pivotal between an extended position for rotating the crank and a folded position for storage, the handle being receivable in a hole on a side of said barrel assembly for securing the handle; and at least one transmission gear assembly rotatably attached to the back of said rail system, the at least one transmission gear assembly rotating in response to rotation of the gear on the crank.

5. The projectile launcher according to claim 4, wherein said cocking mechanism comprises:

an upper pulley assembly rotatably mounted inside said crank housing;

a lower pulley assembly rotatably mounted inside said crank housing, the upper pulley assembly being operatively connected to one side of said transmission gear assembly, the lower pulley assembly being operatively connected to another side of said transmission gear assembly, rotation of said transmission gear assembly rotating the upper pulley assembly and the lower pulley assembly in opposite directions; and an elongate cocking cable attached to said cocking pawl carriage, one end of the cocking cable being anchored to the upper pulley assembly and the other end of the cocking cable being anchored to the lower pulley assembly;

wherein rotation of said transmission gear assembly simultaneously winds and unwinds the cocking cable, facilitating reciprocation of said cocking pawl carriage.

6. The projectile launcher according to claim 3, wherein said bow assembly comprises:

an elongate, resiliently flexible upper bow arm attached to the top of the vertical section of said riser base, the upper bow arm having a wide section, a narrow section continuous with the wide section, and at least one upper pulley wheel rotatably mounted thereon;

an elongate, resiliently flexible lower bow arm attached to the bottom of the vertical section of said riser base, the lower bow arm having a wide section, a narrow section continuous with the wide section, and a cam pulley assembly attached to the narrow section to thereof;

at least one first flex cable trained between the at least one upper pulley wheel and the cam pulley assembly; and at least one second flex cable trained between the cam pulley assembly and the projectile stirrup carriage;

wherein movement of said projectile stirrup carriage towards the cocking position pulls the second flex cable, thereby rotating the cam pulley assembly and winding the first flex cable, and causing the upper bow arm and the lower bow arm to flex toward each other.

7. The projectile launcher according to claim 6, wherein said upper bow arm has a shape different from said lower bow arm.

8. The projectile launcher according to claim 6, wherein said projectile stirrup carriage comprises:

a hemi-circular block having a substantially flat front, a curved side, top and bottom, the curved side having an arcuate guide groove formed therein, the groove guiding said second flex cable;

at least one pair of support tabs radially extending from the top and bottom of the hemi-circular block, the at least one pair of support tabs having a guide roller supported therebetween, the guide roller trapping said second flex cable in the guide groove;

a pair of guide roll stubs attached to the bottom of the hemi circular block, the guide roll stubs directing trained engagement of said second flex cable; and at least one pair of cutouts formed in the hemi-circular block, the cutouts facilitating selective catching of said projectile stirrup carriage by said trigger assembly when in the cocked position.

9. The projectile launcher according to claim 8, further comprising a wear plate attached to the bottom of said hemi-circular block, the wear plate having a pair of elongate guide rails disposed on lateral sides thereof, the guide rails straddling said upper rail section for slidable movement thereon.

10. The projectile launcher according to claim 9, wherein said wear plate is constructed from friction-reducing material.

11. The projectile launcher according to claim 8, wherein said trigger assembly comprises a grip, a trigger adjacent the grip, and at least one catch for selectively engaging the cutouts, the trigger releasing the at least one catch when pulled.

12. The projectile launcher according to claim 1, wherein said barrel assembly further comprises a pair of elongate side panels disposed on lateral sides of said rail system, said rail system having a height, the side panels having a height greater than the height of said rail system, each of the side panels having an arcuate protrusion near the front of said rail system, each of the arcuate protrusions extending toward each other in order to partially cover the top of said rail system to protect a user from a tip of the projectile.

13. The projectile launcher according to claim 12, further comprising an integral quiver attached to sides of said barrel assembly.

14. The projectile launcher according to claim 13, wherein said integral quiver comprises:

a plurality of spaced projectile clamps disposed on said side panels adapted for securing a plurality of projectiles; and a projectile head guard depending from sides of said rail system near the front thereof, the projectile head guard having an opening adapted for receiving tips of the projectile.

15. The projectile launcher according to claim 13, wherein said integral quiver comprises:

a plurality of spaced projectile clamps disposed on said side panels adapted for securing a plurality of projectiles; and a plurality of projectile head guards disposed on said side panels near the front of said rail system, each of the projectile head guards having a scalloped recess adapted for receiving tips of the projectile and a curved cover for covering the tip.

16. The projectile launcher according to claim 1, further comprising a cover protectively covering said bow assembly and the bottom of said rail system; and a rail system support frame protectively covering sides of said riser base and supporting said rail system.

* * * * *